US011089847B2

(12) United States Patent
Golay et al.

(10) Patent No.: US 11,089,847 B2
(45) Date of Patent: Aug. 17, 2021

(54) DEVICE FOR ATTACHING A BRACELET

(71) Applicant: Montres Breguet S.A., L'Abbaye (CH)

(72) Inventors: Patrice Golay, Le Sentier (CH); Fabrice Rochat, Vallorbe (CH)

(73) Assignee: Montres Breguet S.A., L'Abbaye (CH)

( * ) Notice: Subject to any disclaimer, the term of this patent is extended or adjusted under 35 U.S.C. 154(b) by 565 days.

(21) Appl. No.: 16/012,164

(22) Filed: Jun. 19, 2018

(65) Prior Publication Data

US 2019/0000195 A1 Jan. 3, 2019

(30) Foreign Application Priority Data

Jun. 30, 2017 (EP) ..... 17179176

(51) Int. Cl.

| | |
|---|---|
| ***A44C 5/14*** | (2006.01) |
| ***A44C 5/02*** | (2006.01) |
| ***G04B 37/00*** | (2006.01) |
| ***G04B 37/14*** | (2006.01) |

(52) U.S. Cl.

CPC ..... *A44C 5/142* (2013.01); *A44C 5/02* (2013.01); *G04B 37/0008* (2013.01); *G04B 37/1486* (2013.01)

(58) Field of Classification Search

CPC ..... G04B 37/1486; A44C 5/14; A44C 5/142

See application file for complete search history.

(56) References Cited

U.S. PATENT DOCUMENTS

| | | | | |
|---|---|---|---|---|
| 6,098,394 | A | 8/2000 | Hashimoto et al. | |
| 10,606,216 | B2 * | 3/2020 | Dubois | G04B 37/22 |
| 2013/0286796 | A1 | 10/2013 | Chatelain | |
| 2015/0212490 | A1 * | 7/2015 | Cordier | G04B 18/02 368/170 |

FOREIGN PATENT DOCUMENTS

| | | | |
|---|---|---|---|
| CN | 103376734 | A | 10/2013 |
| CN | 106539207 | A | 3/2017 |
| EP | 0 968 670 | A1 | 1/2000 |
| EP | 2 657 795 | A2 | 10/2013 |

OTHER PUBLICATIONS

European Search Report dated Nov. 30, 2017 in European Application 17179176.7 filed on Jun. 30, 2017 (with English Translation of Categories of Cited Documents).

Office Action dated Jun. 22, 2020 in corresponding China Patent Application No. 201810696041.7, 11 pages.

* cited by examiner

*Primary Examiner* — Edwin A. Leon

*Assistant Examiner* — Jason M Collins

(74) *Attorney, Agent, or Firm* — Oblon, McClelland, Maier & Neustadt, L.L.P.

(57) ABSTRACT

A device for attaching a bracelet or strap to a watch case includes a bar secured to the watch case by at least one horn and an insert integral with the end of the bracelet. The bar and the insert are complementary in order to cooperate by fitting one inside the other to form a removable assembly to make the bracelet interchangeable. The bar is formed by a cylindrical arbor having at least one flat portion. The flat portion cooperates by fitting with a housing made in the insert. The housing has a substantially rectangular opening for receiving the flat portion. The bar includes a control member for pivoting the bar from a first position A, in which the insert is positioned on the arbor, to a second position B, in which the insert is locked onto the bar.

15 Claims, 4 Drawing Sheets

DEVICE FOR ATTACHING A BRACELET

This application claims priority from European patent application No. 17179176.7 filed on Jun. 30, 2017, the entire disclosure of which is hereby incorporated herein by reference.

FIELD OF THE INVENTION

The present invention relates to the field of horology or jewelry. More specifically, it concerns a method for attaching a strap or bracelet to an object, particularly a watch case.

BACKGROUND OF THE INVENTION

Generally, straps or bracelets, made of leather or metal, are attached to the horns of a watch case, by means of a bar formed of a tube, inside which are mounted two pistons that move in translation, and an elastic member disposed between said pistons and intended to drive them towards the exterior of the tube. Said bar is mounted inside a housing provided for this purpose at one end of the bracelet, and the pistons are engaged in blind bores made opposite them in the horns of the case.

To detach a strap or bracelet attached to a case in this manner, it is necessary to have a tool designed to push the pistons back inside the tube, against the stress exerted by the elastic member, and thereby remove them from the bores. The wearer of the watch is not permanently equipped with such a tool, and moreover, the tool may prove inconvenient to use. This is why bracelets provided with such an attachment device are generally permanently secured to the case.

There also exist attachment devices allowing the bracelet to be removed from the case without using a tool. Such devices usually comprise a bar, of the type described above, on which is mounted, through the tube, a member for actuating the pistons. Said actuation member is, for example, a radial finger integral with one of the pistons, as described in Swiss Patent No CH327838. The finger is slidably mounted through an axial slot made in the tube, and its movement along the slot pushes one of the pistons inside the tube.

CH Patent No. 614589 discloses a watch case with a device for attaching a strap to the case, the central horn has a cylindrical passage that is slit longitudinally over the entire length of the horn, to allow insertion of a bar for attaching a strap. The bar takes the form of a cylinder with a flat portion over its entire length to allow the bar to pass when it is inserted into the passage and to hold the bar in place when the latter occupies a determined angular position.

The attachment devices thus described are generally employed for interchangeable bracelets or straps which the user can then change as desired. They are not, however, free of drawbacks. It will be noted in particular, that they require major structural modifications to the bar, such as, for example, making an opening in the tube, or transforming the pistons. These changes lead to significant additional manufacturing costs. These attachment devices also include a protruding element, namely the actuating member, which may catch or snag or injure the wearer of the watch.

SUMMARY OF THE INVENTION

The present invention makes it possible to overcome these drawbacks by proposing a device for attaching a bracelet or strap to a watch case, the device comprising, on the one hand, a bar secured to the watch case by means of at least one horn, and on the other hand, an insert integral with the end of the bracelet, wherein the bar and the insert are complementary in order to cooperate by fitting one inside the other to form removable assembly means able to make the bracelet interchangeable.

According to the invention, the bar is formed by a cylindrical arbor having at least one flat portion, said flat portion being arranged to cooperate by fitting with at least one blind housing made in said insert, said blind housing having a substantially rectangular opening for receiving said at least one flat portion of the bar, the bar comprising at least one control member for pivoting the bar from a first position A, in which the flat portion of the bar is able to receive the insert, to a second position B, in which said insert is locked on the bar.

According to other advantageous variants of the invention:

- the control member comprises axial retaining elements, said axial retaining elements being formed by at least one collar at at least one end of the bar;
- said axial retaining elements cooperate with lateral stop surfaces of the watch case;
- said at least one collar comprises a groove arranged to cooperate with a tool;
- said collar comprises a guide-mark indicating first position A;
- said bar comprises a flat portion close to each of its ends;
- said watch case comprises means for maintaining the position of the bar, said maintaining means including at least one ball catch arranged to cooperate with a cavity formed on the arbor of the bar;
- the watch case comprises a median horn including a passage whose diameter corresponds to the diameter of the bar arbor;
- said median horn comprises a removable cap held on the case by means of screws;
- said insert has a C-shaped cross-section.

BRIEF DESCRIPTION OF THE DRAWINGS

Other features and advantages of the present invention will appear more clearly from the following detailed description of an example embodiment of a device for attaching a bracelet according to the invention, this example being given purely by way of non-limiting illustration, with reference to the attached drawing, in which.

DETAILED DESCRIPTION OF PREFERRED EMBODIMENTS

FIGS. 1*a* to 1*d* illustrate a wristwatch and detailed views of the device for attaching bracelet 2 to watch case 1 according to a preferred embodiment of the invention. The device for attaching bracelet 2 to watch case 1 includes, on the one hand, a bar 4 secured to the watch case by means of at least one horn integral with the case, and on the other hand, an insert integral with the end of bracelet 2, wherein bar 4 and insert 20 are complementary to cooperate by fitting one inside the other to form removable assembly means able to make the bracelet interchangeable.

Figure 1B:
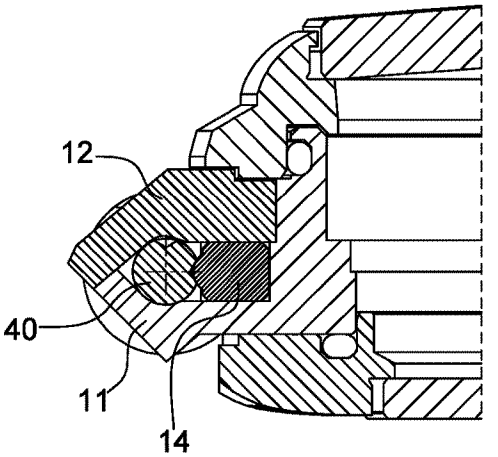
FIGS. 1*a* to 1*d* respectively illustrate perspective and cross-sectional views of a watch case equipped with an attachment device according to the invention.
Figure 1D:
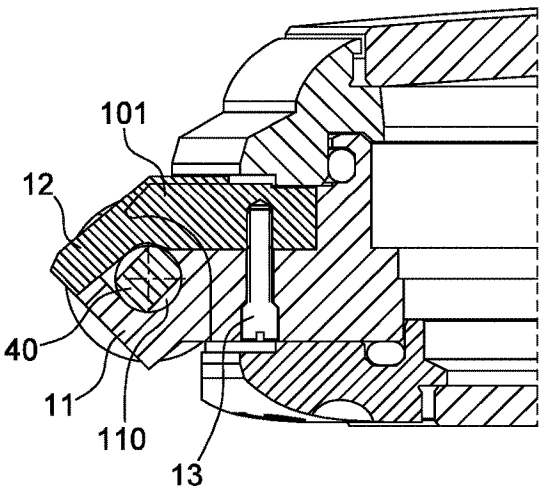
Figure 1A:
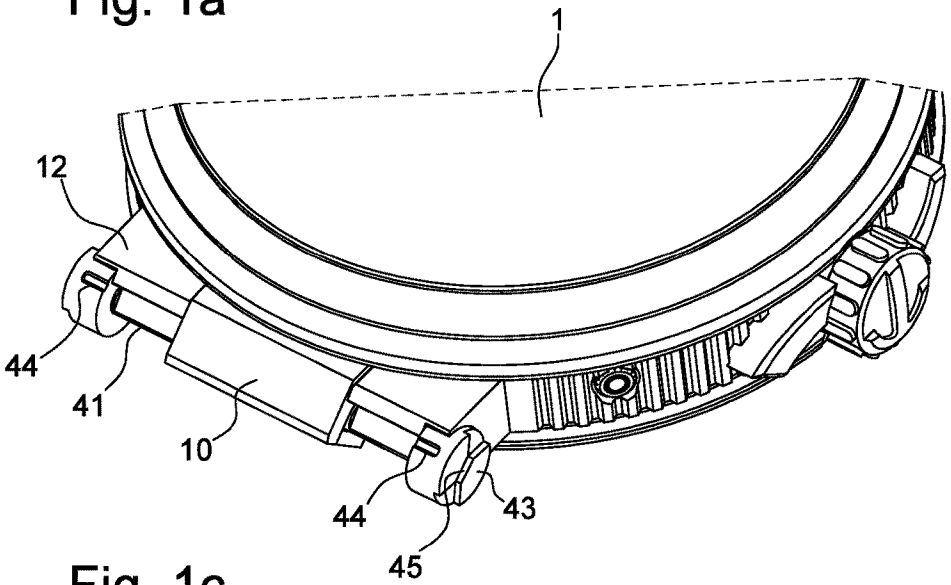
Figure 1C:
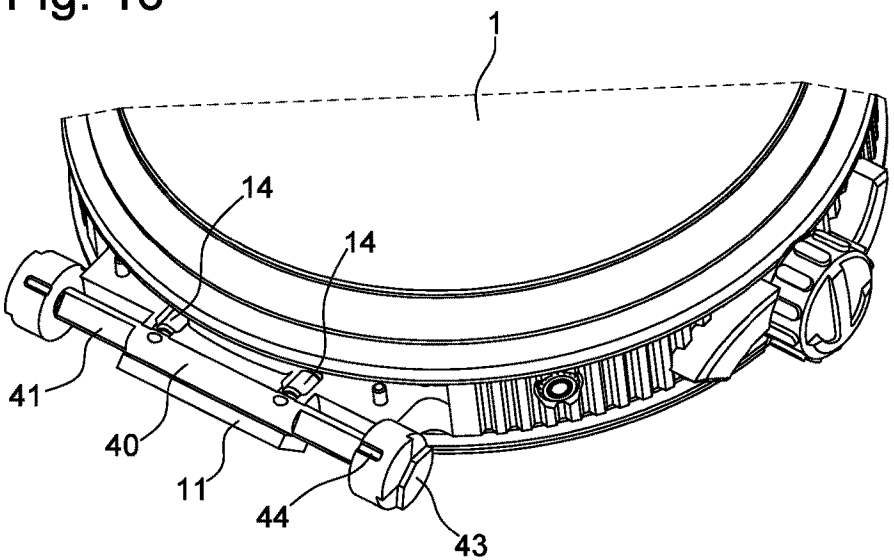

As can be observed in FIGS. 1*c* and 1*d*, the watch case includes a median horn comprising a passage whose diameter corresponds to the diameter of the arbor of bar 4 so that the latter can turn freely inside the housing. Median horn 10 is formed of two parts: a first part 11 formed with the watch case and comprising a groove 110 arranged to receive bar 4, and a second part formed by a removable cap 12 held on the first part, and thereby on watch case 1, by means of screws 13. Such an arrangement allows bar 4 to be assembled and disassembled quickly and easily without risk of damaging or twisting said bar.

Advantageously, watch case 1 includes means for maintaining the position of bar 4. As represented in FIG. 1*c*, these maintaining means take the form of a pair of ball catches 14, each ball catch 14 being arranged to cooperate with a first pair of cavities 42 and a second pair of cavities 42' formed on arbor 40 of bar 4. Of course, those skilled in the art will be able to implement other alternatives to the ball catch, such as a jumper or a spring resting on the flat portion, for example.

According to the invention, bar 4 is formed by a cylindrical arbor 40 having at least one flat portion 41, flat portion 41 being arranged to cooperate by fitting with at least one housing 21 made in insert 20 of bracelet portion 2 or of a link.

Housing 21 has a substantially rectangular opening 210 for receiving flat portion 41 of bar 4, the height and length of opening 210 corresponding to the height and length of flat portions 41 of bar 4.

According to the preferred embodiment of the invention illustrated in the Figures, bar 4 includes two flat portions 41 disposed close to each of the ends of bar 4, so that there is one flat portion 41 on either side of the median horn, each of flat portions 41 cooperating with one insert 20.

Advantageously, bar 4 includes at least one control member for pivoting the bar from a first position A, in which flat portion 41 of bar 4 is able to receive the insert, to a second position B in which said insert is locked onto bar 4.

According to a particular embodiment of the invention, bar 4 can be returned from position B to position A by elastic return means, such as a jumper spring on a cam or a torsion spring on the bar.

As illustrated, the control member includes a collar 43 integral with each of the ends of bar 4, bar 4 and collars 43 thus forming a single element. It is also possible to envisage assembling collar 43 to the end of bar 4 by means of an insertion tip mounted in a hollow part of bar 4. An internal bump is in that case arranged at the end of bar 4 to cooperate with the insertion tip, so as to snap collar 43 into bar 4. Other means of fixing collars 43 can be envisaged, such as, for example adhesive bonding, welding or press fitting. These collars act as axial retaining elements for bar 4 and insert 21.

Thus, bar 4 may be composed of three parts, or may form only one piece, with collars 43 pre-moulded at the ends of arbor 40, flat portions 41 and cavities 42, 42' being then milled directly in arbor 40. Further, the cross-sections of both arbor 40 of bar 4 and of collars 43 are preferably chosen to be cylindrical to facilitate a degree of freedom in rotation about axis A-A.

Advantageously, median horn 10 acts as radial retaining element, complementary to groove 110 whose shape and depth are complementary to that of arbor 40, so that bar 4 cannot come out of groove 110 once it is set in place. In FIGS. 1*c* and 1*d*, it may be noted that median horn 10 includes two housings receiving ball catches 14, the latter being arranged to cooperate with cavities 42, 42' of bar 4, their respective size and depth are configured such that bar 4 has no longer has any degree of freedom in groove 110 when catches 14 are engaged in cavities 42 or 42' of bar 4.

Figure 2B:
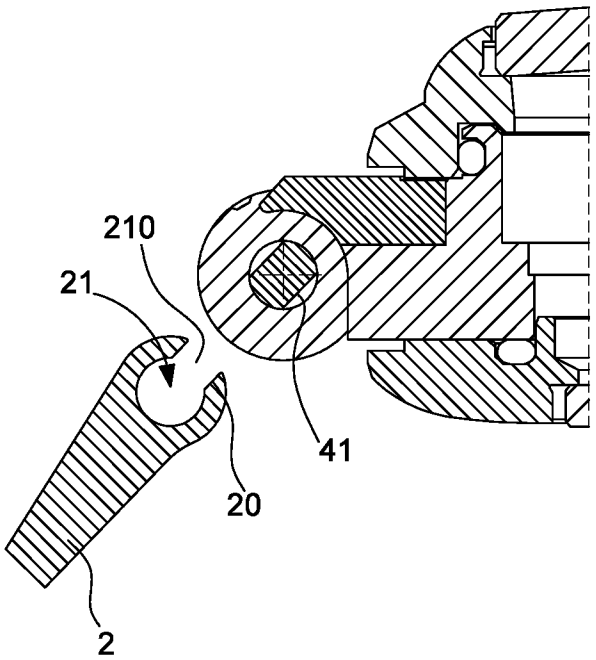
FIGS. 2*a* and 2*b* represent the same watch case with its bracelet before attachment of the latter.
Figure 2A:
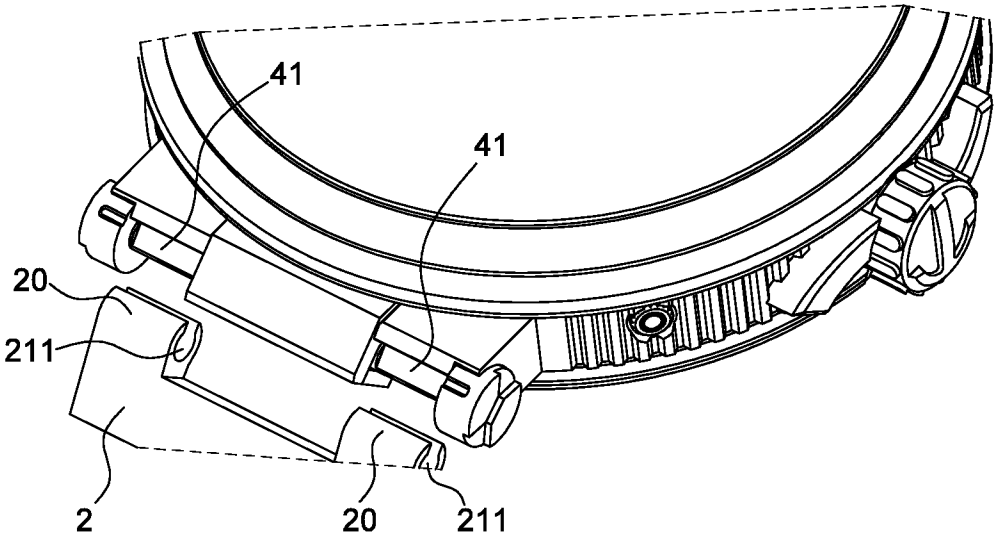

As can be seen in FIGS. 2*a* and 2*b*, the attachment device includes a housing 21 made in insert 20 of the bracelet portion. Housing 21 takes the form of an open housing formed by a cylindrical groove 210 arranged inside insert 20 of the bracelet portion. This cylindrical groove 211 includes a rectangular opening 210 for the insertion and holding of cylindrical bar 4 which has two flat portions 41 to match the shape of the housing. It can thus be observed in the cross-sectional views of FIGS. 2*b* and 3*b* that groove 211 has a C-shaped cross-section.

According to the preferred embodiment illustrated in FIG. 1, watch case 1 has first vertical lateral walls 100, facing which there are provided lateral recesses 101 in the case middle for housing collars 43 therein. As collars 43 preferably have a cylindrical shape here, lateral recesses 101 have a matching hollowed out cylindrical shape in watch case 1.

Figure 3B:
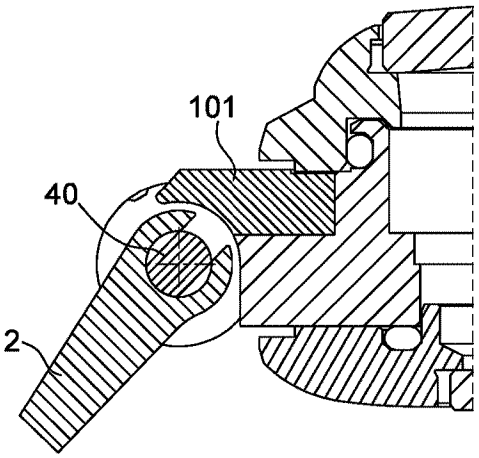
FIGS. 3*a* to 3*c* illustrate the attachment device according to the invention during attachment of the bracelet.
Figure 3A:
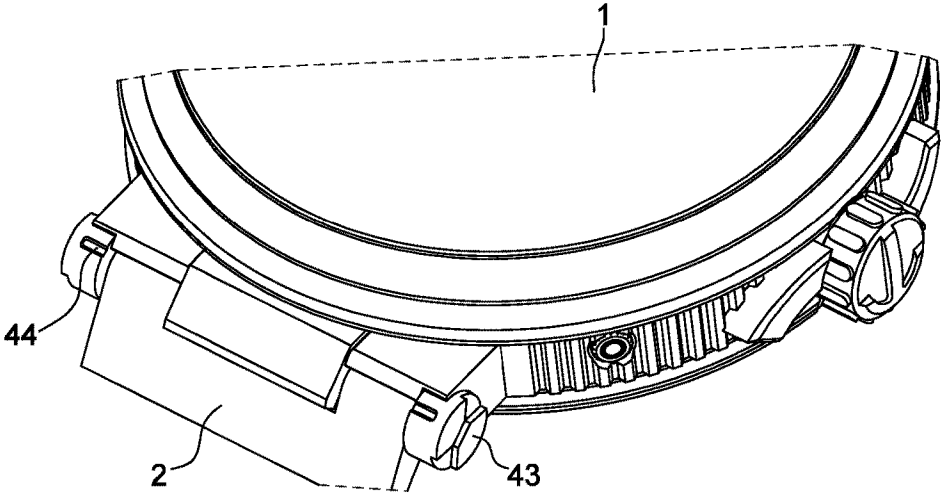
Figure 3C:
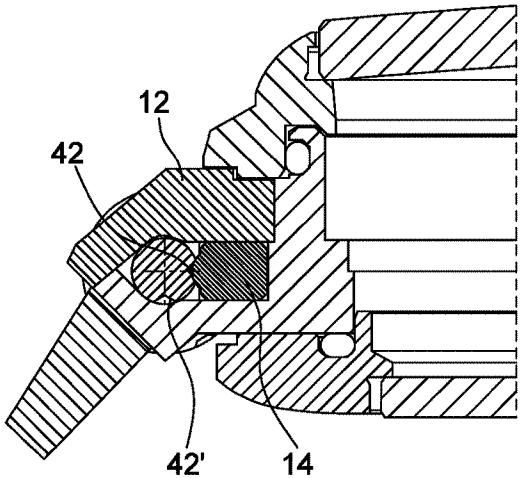

To attach bracelet 2 to case 1, as illustrated in FIGS. 3*a* and 3*b*, insert 21, corresponding for example to the end of a bracelet portion, is inserted into bar 4 by presenting opening 210 of housing 21 opposite flat portions 41 of bar 4 to house bar 4 inside housing 21. To facilitate the proper positioning of flat portions 41, a guide-mark 44 is provided on at least one of collars 43 to indicate first position A of bar 4 for setting insert 20 in position. Further, ball catches 14 are arranged to cooperate with first cavities 42 of arbor 40, once guide-mark 44 is visible to the user, so as to lock arbor 40 in position A.

Figure 4B:
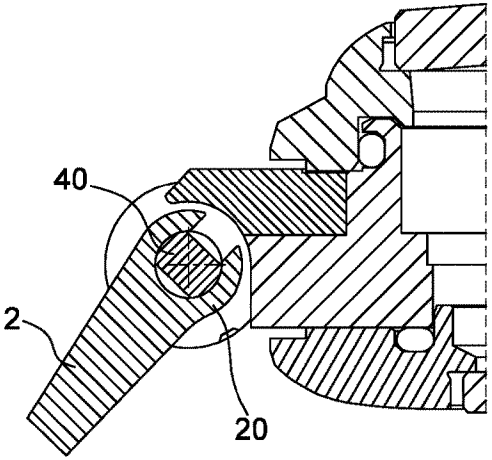
FIGS. 4*a* to 4*c* illustrate the attachment device according to the invention during locking of the bracelet.
Figure 4A:
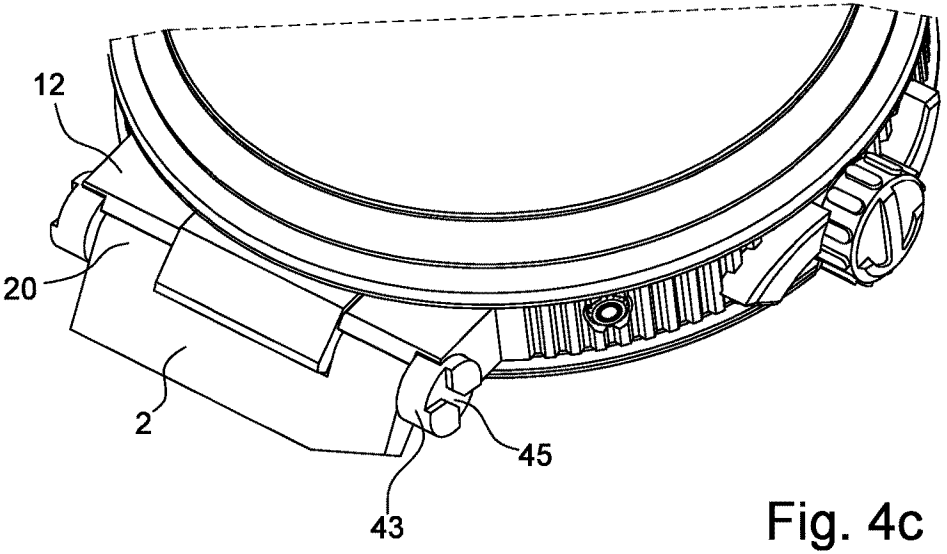
Figure 4C:
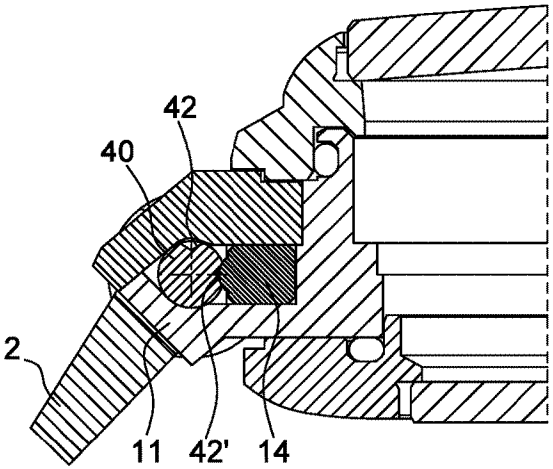

Once insert 21 is in place on bar 4, the user pivots the bar about axis A-A by means of the collars to position B, until flat portions 41 are angularly shifted by at least 45° about axis A-A, and more preferentially by 90°, thus the bracelet portion can no longer be dislodged, as can be observed in FIG. 4*b*. To hold insert 21 in this position, ball catches 14 then cooperate with the second pair of cavities 42' angularly shifted by the same value about axis A-A.

According to the invention, at least one of collars 43 includes a slot 45 arranged on its external face, namely the face visible to the wearer of the watch, to cooperate with a tool or the user's finger to facilitate manipulation of collar 43 and the locking and/or unlocking of insert 20 on bar 4.

Advantageously, insert 20 matches the shape of median horn 10 to limit play during assembly and to provide a high-quality assembly.

In the embodiment described above, the insert is disposed on a bracelet or strap made of leather, synthetic fabric, plastic, metal, ceramic or composite material. Likewise, bar 4 is preferably made of metal but could also be made of plastic, ceramic or composite material.

As a result of these different aspects of the invention, there is provided a secure bracelet attachment device allowing the bracelet to be quickly and easily changed.

Of course, the present invention is not limited to the illustrated example and is capable of various variants and modifications that will appear to those skilled in the art.

What is claimed is:

1. A device for attaching a bracelet or strap to a watch case, comprising:

a bar secured to the watch case by at least one horn; and an insert integral with the end of a bracelet, the bar and the insert being complementary in order to cooperate by fitting one inside the other to form a removable assembly to make the bracelet interchangeable, wherein the bar is formed by a cylindrical arbor having at least one flat portion, said flat portion being arranged to cooperate by fitting with at least one housing made in said at least one insert, said at least one housing having a substantially rectangular opening for receiving said at least one flat portion, the bar comprising at least one control member for pivoting the bar about a longitudinal axis of the bar from a first position, in which the insert is able to be positioned on the arbor of the bar, to a second position, in which said insert is locked on the arbor of the bar.

2. The attachment device according to claim 1, wherein the control member includes at least one collar at at least one end of the bar, said at least one collar forming an axial retaining element.

3. The attachment device according to claim 2, wherein said at least one collar includes a slot arranged to cooperate with a tool to pivot the bar about the axis.

4. The attachment device according to claim 2, wherein the control member includes a collar at each end of the bar, and each of the collars directly abuts the insert to form an axial retaining element that prevents the bar from moving in translation along the longitudinal axis of the bar.

5. The attachment device according to claim 1, wherein said at least one collar cooperates with at least one lateral stop surface of the watch case.

6. The attachment device according to claim 1, wherein said collar includes a guide-mark indicating the first position of the bar.

7. The attachment device according to claim 1, wherein said watch case includes means for maintaining the position of the bar, said maintaining means including at least one ball catch arranged to cooperate with at least one cavity formed on the arbor of the bar.

8. The attachment device according to claim 7, wherein the arbor includes a first pair of cavities arranged to cooperate with a pair of ball catches when the bar is in the first position.

9. The attachment device according to claim 7, wherein the arbor includes a second pair of cavities arranged to cooperate with a pair of ball catches when the bar is in the second position.

10. The attachment device according to claim 7, wherein the first pair of cavities and the second pair of cavities are angularly shifted by 45° about the axis, and more preferentially by 90° about the axis.

11. The attachment device according to claim 7, wherein the arbor includes a first pair of cavities arranged to cooperate with a pair of ball catches when the bar is in the first position, and the arbor includes a second pair of cavities arranged to cooperate with a pair of ball catches when the bar is in the second position.

12. The attachment device according to claim 1, wherein the watch case includes a median horn including a passage whose diameter corresponds to the diameter of the arbor of the bar.

13. The attachment device according to claim 12, wherein said bar includes a flat portion close to each of its ends, one flat portion being arranged on either side of the median horn.

14. The attachment device according to claim 12, wherein said median horn includes a removable cap held on the case by means of screws.

15. The attachment device according to claim 1, wherein said housing takes the form of a groove with an opening, the housing having a C-shaped cross-section.

* * * * *